United States Patent [19]

Bowditch

[11] Patent Number: 4,675,253

[45] Date of Patent: Jun. 23, 1987

[54] METHOD AND PATTERNS FOR MAKING FLAT PLANE SEAMED GARMENTS

[75] Inventor: Philip N. Bowditch, Cohasset, Mass.

[73] Assignee: The Charles Stark Draper Laboratory, Inc., Cambridge, Mass.

[21] Appl. No.: 731,990

[22] Filed: May 8, 1985

[51] Int. Cl.[4] ..... B44F 3/00

[52] U.S. Cl. ..... 428/542.8; 2/243 B; 33/17 A; 112/262.1

[58] Field of Search ..... 2/243 B; 33/17 A; 428/542.2, 542.8; 112/262.1

[56] References Cited

U.S. PATENT DOCUMENTS

| | | | |
|---|---|---|---|
| 2,792,572 | 5/1957 | Rosenbaum et al. | 2/90 |
| 3,129,432 | 4/1964 | Belkin | 2/114 |
| 3,470,568 | 10/1969 | Belkin | 2/114 |
| 3,900,633 | 8/1975 | Piron | 428/42 X |
| 3,949,629 | 4/1976 | Johnson | 428/900 X |
| 4,224,358 | 9/1980 | Hare | 428/485 X |
| 4,401,044 | 8/1983 | Bowditch | 156/93 X |
| 4,462,118 | 7/1984 | Bowditch | 2/243 R |
| 4,510,626 | 4/1985 | Bowditch | 2/115 |
| 4,532,655 | 8/1985 | Bowditch | 2/113 X |
| 4,558,420 | 12/1985 | Gerber | 364/470 X |

FOREIGN PATENT DOCUMENTS

| | | | |
|---|---|---|---|
| 955868 | 4/1964 | United Kingdom | 33/17 A |
| 2132383 | 7/1984 | United Kingdom | 2/243 B |

*Primary Examiner*—Henry F. Epstein

*Attorney, Agent, or Firm*—Lahive & Cockfield

[57] ABSTRACT

A method and pattern for making seamed articles which eliminate at least in part the need to initially precision-cut panels for piecewise assembly. The method and pattern are designed for use on sheets of fabric or the like, to generate a set of indicia. The indicia mark the seams to be formed of each panel, and lines about which the material can be folded to form the seams without cutting. Reference lines may also be used to permit precise panel-to-panel alignment prior to seam joining. In use, the pattern is applied to the material and the patterned material is folded along a fold line. The seams are then aligned so that they can be joined (e.g., by sewing or by fusing). The folding and joining steps may next be repeated to add further panels to the assembly. Finally, excess material may be removed if desired, by cutting beyond the seams.

14 Claims, 5 Drawing Figures

METHOD AND PATTERNS FOR MAKING FLAT PLANE SEAMED GARMENTS

REFERENCE TO RELATED APPLICATIONS

The subject matter of this application is related to the subject matter of U.S. patent application Ser. No. 500,080, entitled "Flat Plane Seam Garment and Method of Making", filed June 1, 1983, now U.S. Pat. No. 4,510,626 and U.S. patent application Ser. No. 565,377, entitled "Method of Generating a Pattern of a Flat Seam Garment Therefor", filed Dec. 27, 1983, now U.S. Pat. No. 4,532,655 both assigned to the assignee of the present invention.

BACKGROUND OF THE INVENTION

The technical field of this invention is clothing manufacture and, in particular, assembly of clothing from patterned fabric.

Garments have long been made by joining two or more panels of limp fabric to form seams, so that the composite surface of the joined panels forms a desired three dimensional contour. Typically, the design process for a garment includes the step of segmentation of the desired finished contour into planar patterns having shapes corresponding to panels for the garment. These patterns are used to generate the panels which may be cut from a portion of a limp fabric while that portion is positioned in a plane.

In many instances, the assembly of a piece of clothing from numerous panels can be difficult, tedious and prone to error. For home seamstresses, the need to cut and keep track of numerous panels of fabric can be an arduous task. An improperly cut panel can be incorporated into the article and may go unnoticed until the final stages of assembly, resulting in an undesirable end item. Similarly, the joining of cut panels, particularly those of odd shapes, can often lead to mismatching of seams, mismatching of decorative patterns on the panels at the seams, or other mistakes in assembly. The result in each of these instances is the need to undo the assembly or start again with new panels.

Moreover, conventional assembly of seamed articles includes the steps of generating panels from patterns where the intended seam locations are determined by using predetermined offsets from the edges of the pre-cut panels. U.S. Pat. No. 4,462,118 discloses a method of making a garment utilizing such predetermined offsets, although that patent does disclose a flat plane sewing technique as well. However, it is the actual location of the seams which provide the desired degree of fit for a garment. Accordingly, errors in the location of edges of the conventional pre-cut panel techniques lead to corresponding errors in the eventual seam locations. These errors generally have two components; namely, edge matching errors (due to cutting errors and visual edge matching imperfections, and tactile skills of the article assembler) and seam set-back errors (due to visual and tactile accuracies of the assembler).

It is known to assemble a seamed article from a single strip of material so that intended adjacent panels and regions to be joined overlap, and then the seams are joined and the excess fabric is cut away (See U.S. Pat. No. 4,401,044), particularly in the context of an automated assembly system. There is no known technique which addresses the setting of a pattern in material for use in article assembly which does not include reference to the use of panel selvage boundary information generally, or particularly in the pre-cutting of panels, with selvage, for assembly There exists a need for simpler methods of manufacturing seamed garments and other articles. Patterns which allow a seamstress to assemble precision fit articles with a minimum of preparatory steps, would satisfy a variety of needs in the clothing industry.

SUMMARY OF THE INVENTION

The present invention resides in methods and patterns for making seamed articles which eliminate at least in part (and preferably completely eliminate) the need to initially cut panels for piecewise assembly. Briefly, the invention is directed to a pattern for a seamed, multiple panel article-to-be-assembled from one or more limp material segments. The pattern includes a set of information elements associated with the segments, where the set is representative of the locations, or loci, of panel-to-panel joining seams to be formed during assembly of the article, and fold lines about which the segment can be folded so that the seams can be overlapped and joined in a flat plane. The set is also representative of information elements associated with reference lines (or designators) in addition to those representative of fold lines. The reference lines are useful in establishing precise panel-to-panel alignment, for example, to permit alignment of the panel pattern with respect to ornamented design on the fabric or a bias or weave in the fabric.

The methods and patterns may be designed for use on sheets of fabric or the like, to generate indicia representative of the set of information elements. The indicia may mark the constructional boundaries, desired references, seams to be formed for each panel, and lines about which the material can be folded to allow the seams to be formed without pre-assembly, precision cutting. Indicia representative of panel boundaries are not necessary. The set of information elements may alternatively be in a data format resident in the memory of a data processor.

In use, in one form, the pattern is aligned with the material and applied to the material, and then the material is folded along a prescribed fold line. The seams are thereby aligned so that they can be joined (e.g., by sewing or by fusing). The folding and joining steps may next be repeated to add further panels to the assembly. Finally, excess material may be removed if desired, by cutting beyond the seams.

While in some senses, this approach may seem somewhat wasteful of fabric in comparison to prior art approaches which "optimally" use fabric in terms of panel organization and cutting, the present invention prevents the occurrence of many common mistakes in cutting and assembling panels and simplifies the fabrication of seamed articles directly from a strip of material, particularly in cases where it is desired to maintain pattern matching from panel-to-panel, as in a garment made from a fabric having a plaid pattern.

In one form of the invention, patterns are disclosed for assembling a seamed, multi-panel article from a single piece or segment of material (e.g., a fabric, sheet or film material suitable for use in a garment). In alternated form, multiple segments may be used. As used herein, the term "article" refers to a sub-component of a garment assembly (for example, two joined panels which might be used in a garment), or an entire garment assembly. The pattern is carried by a sheet member which corresponds in size to the material segment and serves to generate on the material segment a set of markings or "indicia". The indicia are representative of the joining seams for the panels, and the fold lines. The patterns permit a user to assemble a garment or similar article according to the "sew first, cut later" technique, described above.

In one embodiment, the patterns are carried on sheet members which include releasably-affixed transfer elements. The sheet member with the transfer elements is placed upon the material segment and the elements are transferred to form a visible pattern on the material segment by application of heat or pressure or both to the sheet.

In another embodiment, the patterns can be carried on a sheet member which serves as a template. The template includes a set of holes corresponding to the seam and fold line and reference line indicia required for assembly of the article. In this embodiment, the template is placed upon or adjacent to the material and the pattern is stenciled onto the material by using the template as a mask, for example using a suitable spray-on marking medium. In yet another embodiment, the patterns can be printed onto the material segments by employing an inked plate, embossed roller or the like.

In each of these embodiments, it is preferred to also include alignment markers on the material segment and the pattern which can be superimposed to ensure that the pattern is properly transferred from the sheet member to the material segment. It is also preferred that the indicia or markers on the material segments be water soluble or otherwise washable so that the pattern does not remain on the finished article.

Thus, according to the invention, patterns are generated which ensure that the article to be constructed can follow a series of flat plane pre-joining alignment checks. Each assembly step therefore can be visually verified in terms of the as-to-be joined panel alignments and constructional accuracy by confirming that the as-to-be sewn condition of the assembly does in fact lie in a flat plane, a feature which is not possible with prior art patterns. These benefits in constructional ease and accuracy afforded by the present invention substantively reduce the article construction time, as well as assure an accurate and pleasing end item, particularly for the unskilled seamstresses.

Moreover, the characteristics of fabric marked with pattern indicia according to the invention i.e., references, fold, as well as specifically desired seam lines, provide a seamstress with specific indicators of how to align adjacent panels prior to stitching. Further, precision cutting of panels is delayed until after the joining has been accomplished. Clearly, the seam lines so marked on a panel represent the desired panel to panel assembly geometry for realizing a proper end item construction. Failure to specifically use these lines will put the final construction at risk.

In the event that panels of patterned fabric are desired for the garment, marking of the desired seam lines on the fabric will allow the assembler to verify by inspection the inter-panel registration and alignment accuracies prior to joining and cutting. One final virture of delaying precision cutting until assemblies are joined is that where arm, neck, and other reentrant curves are present in the article, the ability to leave fabric uncut in these areas will improve the stability of these areas during sewing (i.e., pseudo-rigidization).

A further significant element of this inventon is embodied in a component which can be used by home seamstress and other unskilled assemblers. If the pre-joining alignment of panels is performed on a styrofoam, or other easily piercable block plane, seam pinning (which for home seamstresses is a standard assembly practice prior to joining) can be significantly eased. Straight through pinning at seam end and seam redirection points will assure overall subsequent seam pinning accuracies. Further, necessary indicia references to be marked on the flip side of the fabric can be easily transferred by straight through pinning followed by turning of the fabric and pick up of the pin penetration positions on the flip side.

The invention will next be described in connection with certain preferred embodiments and illustrations; however, it should be clear that those skilled in the art may make various changes and modifications to the invention without departing from the spirit or scope of the claims.

DESCRIPTION OF THE PREFERRED EMBODIMENT

Figure 1:
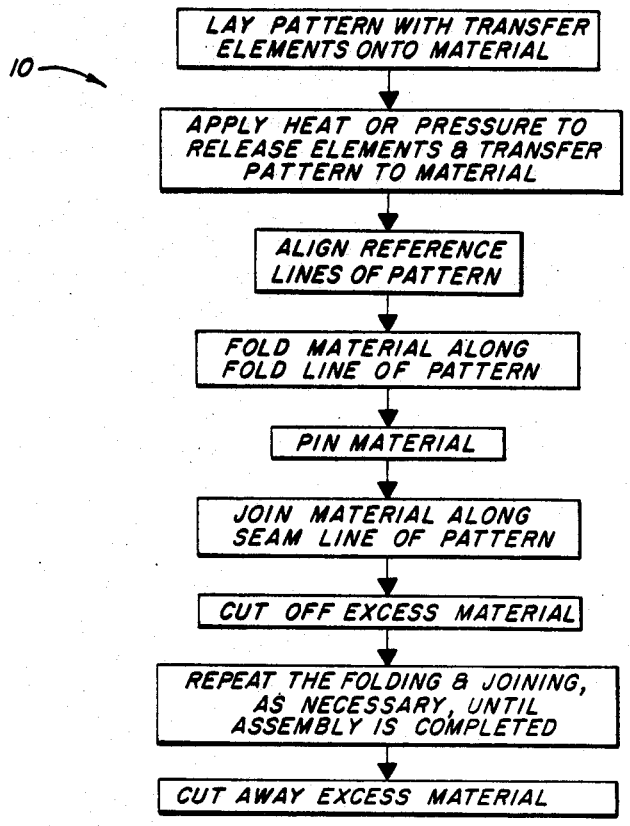
FIG. 1 is a block diagram describing the pattern transferring techique of the invention.

In FIG. 1, a block diagram 10 is shown describing the process by which a pattern, according to this invention, may be transferred from a sheet member to a material segment. Essentially, the sheet member is originally formed with the pattern embossed thereon, including the boundary lines, the joining seams, and the fold lines and reference lines. These indicia are formed from a releasably-affixed transfer material. Such transfer materials are well known in the art and described, for example, in U.S. Pat. No. 3,900,633 and the references cited therein, the teachings of which are herein incorporated by reference. Typically, when using the transfer technique, the sheet material is composed of a waxed paper or a plastic film and the transfer material includes a pressure or heat sensitive adhesive and suitable pigments.

Once the pattern is prepared upon the sheet member, the sheet member is then laid upon the material segment such that the transfer elements are in contact with the material. Heat and/or pressure are then applied to release the transfer elements from the sheet member and transfer the pattern to the material. The sheet member can then be discarded and the pattern employed to assemble the garment. Alternatively, the templates for the various panels may be shaped in the form of the panels and may be made of rigid material (or semi-rigid material, such as cardboard). Those rigid pattern sections may be connected by flexible couplings so that an assembler may merely unfold an assembly of rigid panel patterns and merely trace the contours of the respective panel patterns with a working instrument to generate the seam indicia on the material. During this process, the material may initially be laid out in a planar work surface made of solid material such as stryofoam or cork, and held in place by pins inserted through the material and into the work surface.

Typically, the article assembly process begins by folding the material segment along one of the fold lines of the pattern, pinning the folded layers in position, and then joining the material along the seam line of the pattern by sewing or fusing or a similar technique. The steps of folding and joining are repeated as necessary and then excess material may be cut away from regions adjacent to the seams.

Figure 2:
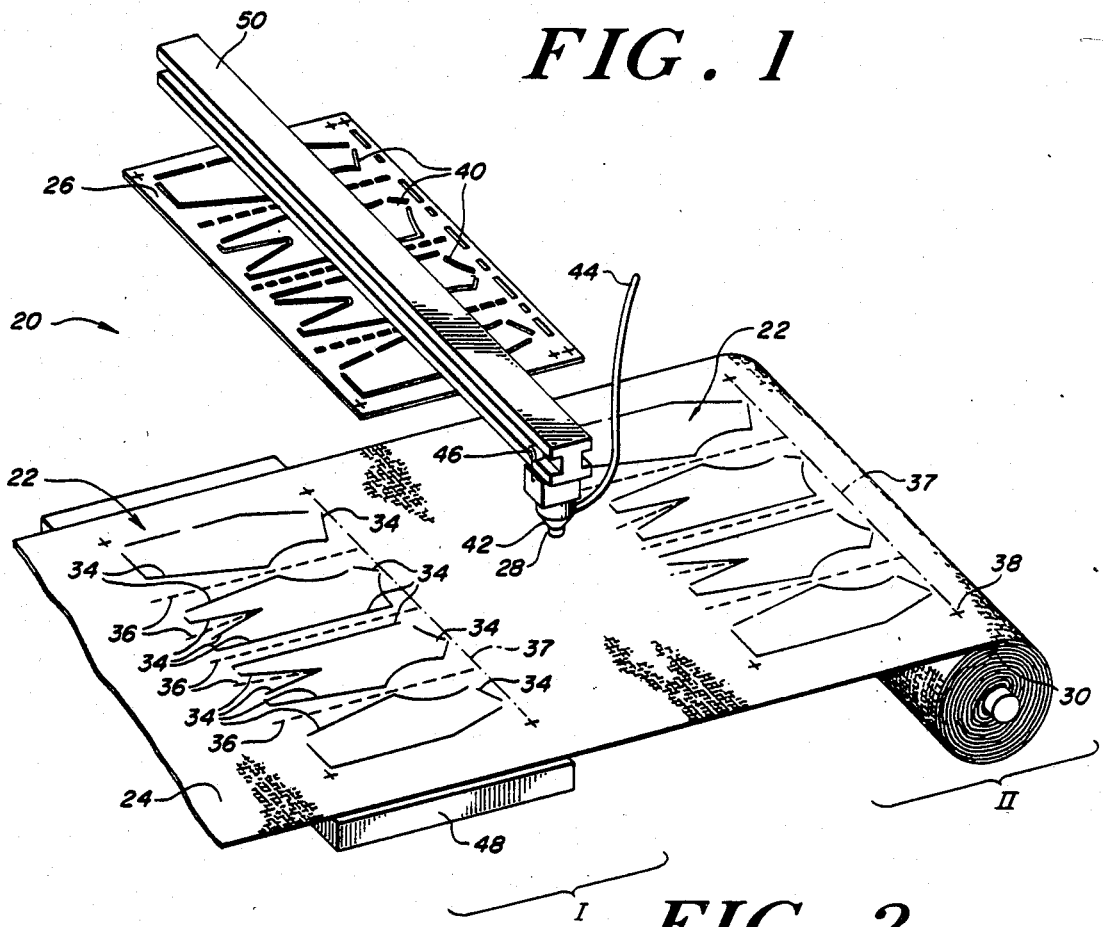
FIG. 2 is a schematic, perspective view of an apparatus for generating the patterns of the present invention.

In FIG. 2, another technique for generating patterns on material segments is shown. The apparatus 20 generates a pattern 22 on a material 24 employing a stencil template 26 and a source of marking material 28. The process is designed for automated operation and generates repetitive patterns on segments of the material as the material is conveyed past the template 26 and marking means 28. Each segment may be then cut from the material after the pattern is generated or the material may be taken up by a take-up roll 30, as shown, for subsequent finishing. FIG. 2 shows two segments, I and II, each including indicia for the seams and fold lines for a four panel vest.

As can be seen in FIG. 2, the pattern 22 on the material 24 includes a number of indicia. The seam lines 34 mark those areas where the individual panels are to be joined and the fold lines 36 mark the lines about which the material segment is folded so that the seams can be overlapped and joined. The dot-dash lines 37 denote reference lines which are used to align the panel patterns with respect to the material. Additionally, one or more alignment markers 38 may be included on the template 26 to ensure proper alignment with the material 24.

In FIG. 2, the relationship between the material 24, the template 26, and the marking means 28 is shown in schematic, exploded view (without the attendant control and support structures for simplfied illustration). In use, the material passes above a back plate 48 and below the template 26, which template is preferably in a close but non-contacting relationship with the material 24. When the template 26 and the material segment 24 are aligned, the marking means 28 can then proceed to mark the pattern 22 on the material 24 through the holes 40 in the template 26. In the illustrated embodiment, the marking means 28 includes a spray nozzle 42 and a source of marking material 44. The marking means 28 is carried on a roller bearing 46 and traverses the template 26 along guide rail 50.

It should be clear that the apparatus described in FIG. 2 can be modified or replaced by various other means for generating a pattern on a material segment. For example, the spray nozzle 42 of the marking means 28 can be replaced by a paint roller or similar device that passes a marking material through the template to the material segment. Similarly, the template itself can be formed with raised surfaces rather than holes and function to transfer the pattern lithographically instead. Various other printing technologies may also be employed to transfer the patterns directly onto the material segments for use.

Figure 3:
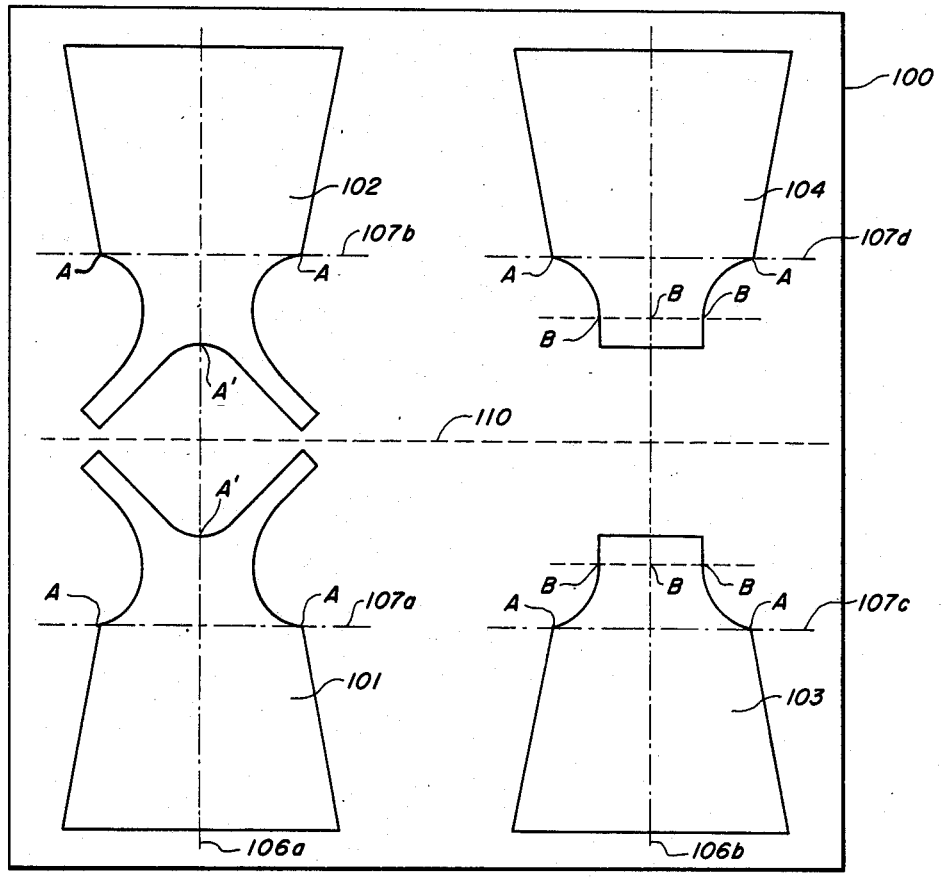
FIGS. 3–5 illustrate the steps of assembly of an exemplary article in keeping with the present invention.

FIG. 3 illustrates an exemplary garment pattern in accordance with the present invention, on the "wrong" side of a material segment 100 laid out on a planar surface. The pattern of FIG. 3 defines four panels 101–104 and shows indicia for panel-to-panel joining seams (shown with solid lines) and indicia for fold lines (shown with dashed lines). Reference lines (shown as dash-dot lines 106*a*, 106*b* and 107*a*, 107*b*, 107*c*, 107*d*) aid in aligning the folded segments of the material, for example, to assure established orientation of the panels with respect to a bias or weave or ornamental design in the material. By way of example, these patterns may be transferred to a material segment by tracing about rigid (e.g., card-board) pattern forms. Following the transfer of the pattern of FIG. 3 to the material segment 100, with that material segment 100 being supported on a planar work surface, the uppermost portion of the segment is folded about fold line 110 so that panel 102 overlies panel 101 and panel 103 overlies panel 104, in both cases with the "right" material surfaces facing each other. The reference lines of the respective panels may be used to assure precise alignment of the overlaid panels.

Then, the contours A-A'-A of the panels 101 and 102 are joined in a flat plane, and the contours A-B-B-B-A of panels 103 and 104 are joined in a flat plane. To aid in this flat plane joining operation the respective panels may first be overlaid on a styrofoam or cork planar surface and then pinned so that precise seam locations may be accomplished. When so pinned, the overlaid panels are in a planar relationship.

The joined panels 101 and 102 (sub-assembly 120) and joined panels 103 and 104 (sub-assembly 122) are then trimmed outside the seams, the selvage is notched (after sewing, permitting maintenance of fabric alignment), and those sub-assemblies are turned inside out so that the "wrong" sides face each other in each sub-assembly 120 and 122.

Figure 4:
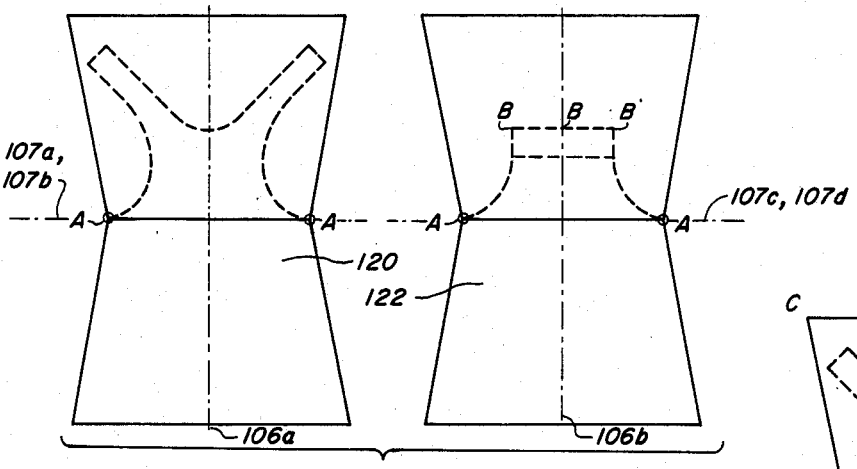
Figure 5:
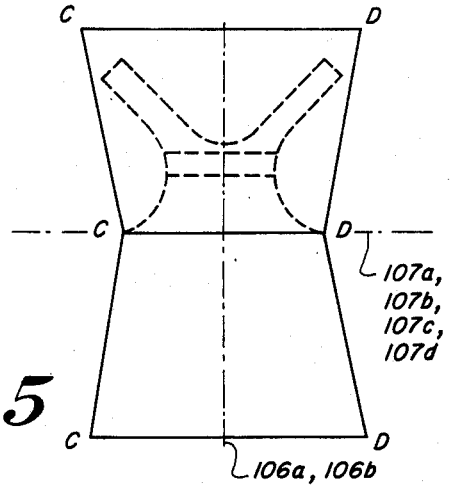

The sub-assemblies 120 and 122 are positioned on the planar work surface as shown in FIG. 4; that is, with the unsewn portions folded open about axes passing through points A,A in each sub-assembly, those fold axes being coincident with reference lines 107*a*–107*b* and reference lines 107*c*–107*d*, respectively. Then sub-assembly 122 is flipped over (bad side down) and sub-assembly 120 is overlaid onto sub-assembly 122 (as shown in FIG. 5), and flat plane seams C-C-C and D-D-D are formed in a flat plane. Again, to aid in this flat plane joining operation, the sub-assemblies may be overlaid and pinned on the planar stryofoam or cork work surface.

Finally, the uppermost (as shown) edges CD of the composite assembly are pulled down and over the rest of the assembly so that that uppermost edges CD is substantially even with the lowermost edges CD. Those edges are then joined to form a hem, resulting in a fully assembled, reversible jumper garment.

Accordingly, with the above described assembly, the article is assembled using only flat plane seam joining techniques, permitting easy assembly using conventional flat plane sewing devices. Notably, all seams of the article are invisible (i.e., on the inside), and the article requires no bias tape, as in conventional type jumpers. In other forms of the invention, for example, the four panels 101–104 may be roughly pre-trimmed and then assembled in generally the same manner as above (eliminating the folding about line 110) but maintaining segment-to-segment alignment using the reference lines.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A pattern for a seamed, multiple panel article of clothing to be assembled from one or more limp material segments, comprising:

a set of information elements associated with each of said segments, said set being representative of the locations on said segments of:

A. panel-to panel joining seams to be formed during the assembly of said article, B. fold lines about which said segments can be folded so that selective ones of said seam locations can be overlapped in a flat plane and said seams can be joined in a flat plane, and C. reference designators representative of the relative orientation of said seam and said fold line locations.

2. A pattern according to claim 1 wherein said set comprises a sheet member adapted for use in generating indicia on said segments, said indicia being representative of said locations.

3. A pattern according to claim 2 wherein said sheet member includes transfer elements releasably affixed thereto, said transfer elements being adapted for selective transfer of said indicia to portions of said segments adjacent thereto.

4. A pattern according to claim 3 wherein said transfer elements are adapted for said selective transfer in response to the application of heat and pressure thereto.

5. A pattern according to claim 2 wherein said sheet member is a template including a set of holes passing therethrough, wherein the boundaries of said holes correspond to the boundaries of said indicia.

6. A pattern according to claims 2, 4 or 5 wherein said sheet member has at least one alignment marker adapted to match an alignment marker on said segments, whereby the relative location of the respective indicia is established when said segment alignment marker overlies said sheet member alignment marker.

7. A method for generating a pattern on one or more limp material segments to permit the assembly of a seamed multiple panel article of clothing therefrom in a flat plane, the method comprising the steps of:

A. generating seam information elements associated with said segments which are representative of the locations on said segments of panel-to-panel joining seams to be formed;

B. generating fold information elements associated with said segments which are representative of the locations on said segments of the fold lines about which said segments can be folded so that selective ones of said seam locations can be overlapped in a flat plane and said seams can be joined in a flat plane, and C. generating reference information elements representative of reference designators for aligning said seam locations and said fold line locations on said segments.

8. The method according to claim 7 wherein said generating steps include the steps of generating indicia on said segments representative of said information elements.

9. The method of claim 7 wherein the pattern is generated by transferring releasable-affixed transfer elements corresponding to said information elements from a sheet material to said material segment.

10. The method of claim 7 wherein the releasable elements are transferred by heat and pressure.

11. The method of claim 7 wherein the pattern is generated by placing a template with holes corresponding to the information elements upon said material and painting said template to impart said pattern to said material segments.

12. The method of claim 7 wherein the pattern is generated by a marking material applied to an embossed roller surface.

13. The method according to claims 7, 8, 10, 11 or 12 wherein the method further comprises aligning at least one marker on said material segments with at least one alignment marker of said pattern.

14. The method according to claim 7 wherein said generating steps include the steps of generating binary data representative of said information elements and storing said data in the memory of a data processor.

* * * * *